United States Patent [19]

Henderson

[11] 4,429,506

[45] Feb. 7, 1984

[54] INTERLOCKING BUILDING BLOCK

[76] Inventor: Eugene R. Henderson, 3502 The Alameda, Baltimore, Md. 21218

[21] Appl. No.: 366,729

[22] Filed: Apr. 8, 1982

[51] Int. Cl.[3] ..... E04B 1/00

[52] U.S. Cl. ..... 52/589; 52/593; 52/274; 52/284

[58] Field of Search ..... 52/591, 590, 593, 259, 52/589, 284, 286, 274; 404/41; 46/21, 24, 25

[56] References Cited

U.S. PATENT DOCUMENTS

| | | | |
|---|---|---|---|
| 2,613 | 2/1872 | Douglas | 52/574 |
| 8,041 | 4/1839 | Stead | 404/41 |
| 195,286 | 9/1888 | Ingalls | 404/41 |
| 1,092,621 | 4/1914 | Worner | 52/574 |
| 1,186,673 | 6/1916 | Mallett | 52/591 |
| 1,189,388 | 7/1916 | Rogers | 52/590 |
| 1,269,674 | 6/1918 | Bacigalupo | 52/574 |
| 1,336,789 | 4/1920 | Sheen | 52/590 |
| 1,852,715 | 4/1932 | Greenebaum | 52/591 X |
| 1,929,073 | 10/1933 | MacDonald | 52/561 |
| 2,708,329 | 5/1955 | McKee | 52/589 |
| 2,861,388 | 11/1958 | Favaretto | 52/593 X |
| 3,229,432 | 1/1966 | Renfro | 52/589 |
| 3,238,680 | 3/1966 | Blair | 52/590 X |
| 3,305,982 | 2/1967 | Steele | 246/167 R |
| 3,456,413 | 7/1969 | Fischer | 52/591 |
| 3,643,392 | 2/1972 | Martinez | 52/590 |
| 3,956,862 | 5/1976 | Alexandre | 52/589 |
| 4,041,660 | 8/1977 | Yensen | 52/590 |
| 4,258,522 | 3/1981 | Amaral | 46/25 |

FOREIGN PATENT DOCUMENTS

| | | | |
|---|---|---|---|
| 585749 | 10/1947 | United Kingdom | 52/590 |

*Primary Examiner*—John E. Murtagh
*Assistant Examiner*—Kathryn L. Ford
*Attorney, Agent, or Firm*—Shlesinger, Arkwright, Garvey & Fado

[57] ABSTRACT

An interlocking block has a specially configured interlocking block element having accurately positioned surfaces which are inclined to provide a guiding and seating action and an accurate position stop for an adjacent block that is interengaged with the interlocking block element.

6 Claims, 16 Drawing Figures

FIGURE 1
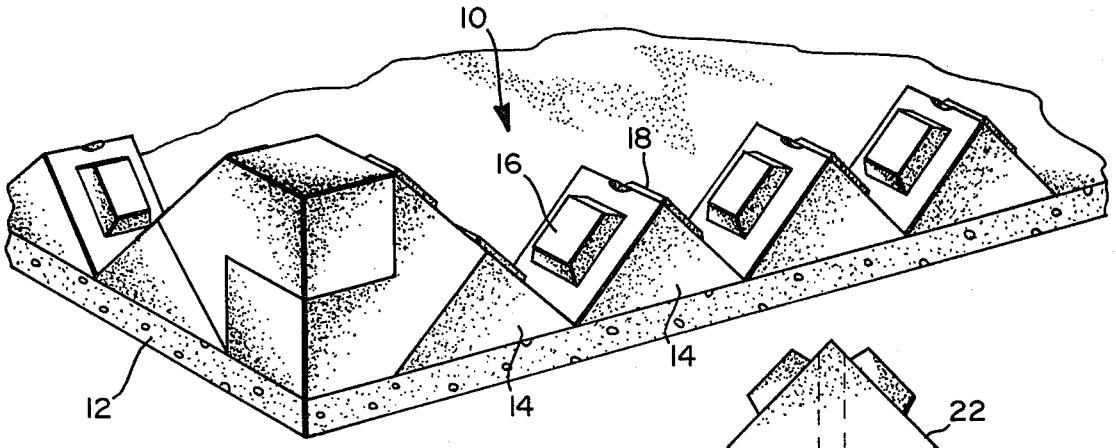
FIGURE 2
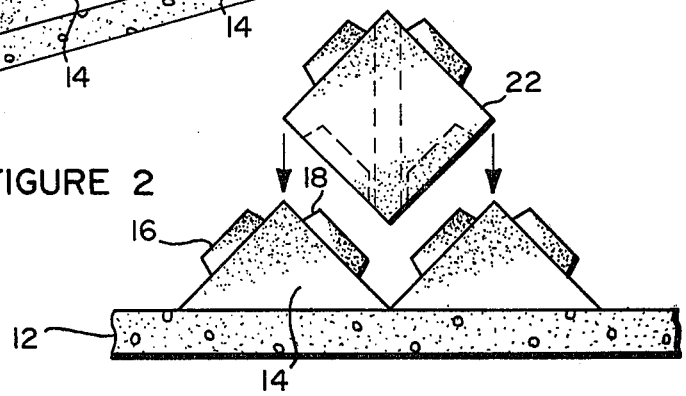
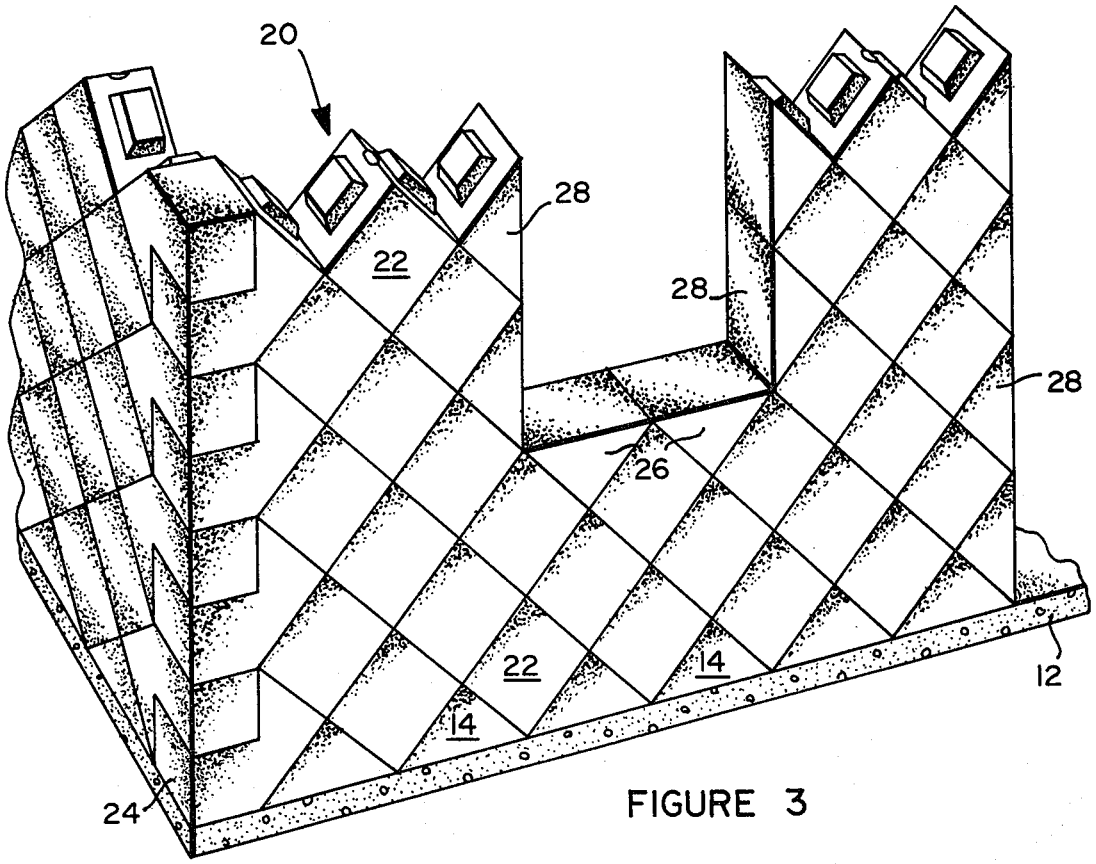
FIGURE 3

INTERLOCKING BUILDING BLOCK

BACKGROUND OF INVENTION

This invention relates to interlocking building blocks, and particularly to particularly configured blocks for such use.

The need for a versatile building block which can be readily assembled by unskilled labor has been recognized and several different types of interlocking building blocks have been proposed.

The use of a stepped configuration on the top of a conventional rectangular-shaped cinder block which matches with the bottom face of the succeeding block to be placed above the first block is disclosed by the Smith U.S. Pat. No. 2,911,818. The upwardly extending projecting stepped surfaces are designed to hold succeeding courses of cinder block in position by means of this configuration.

Another type of interlocked block construction uses a square-shaped block mounted in a diamond configuration in a wall as shown by the Blair U.S. Pat. No. 3,238,680. A V-shaped groove construction is disclosed immediately adjacent the front face of the block for providing an interlock fit of adjacent blocks.

Another type of interlocking block construction used for buildings is disclosed in the Steele U.S. Pat. No. 3,305,982 which uses a combination of dove-tailed end-interlocking elements and an upwardly extending interfitted projection on the top face of each block.

Each of these constructions has been directed toward providing a simpler method of constructing buildings with blocks in which relatively unskilled labor could be employed to rapidly produce a satisfactory building. However, the previously proposed constructions have limitations, either with respect to ease of installation, ability to maintain a level course, or stability of the interlocked block construction.

SUMMARY OF INVENTION

Accordingly, it is a principal feature of this invention to provide a new interlocking block construction.

It is a further feature of this invention to provide an interlocking block which can be more easily used by unskilled labor and more rapidly installed.

A still further feature of this invention is to provide an interlocking block construction which can be very quickly installed into final interlocked position with an accurate fit and which, when in place, provides more strength than previous types of construction.

Another feature of this invention is to provide a building block which is self-leveling.

It is a further feature of this invention to provide an interlocking block configuration usable with different specialized block constructions usable for corners, doors and windows.

It is a still further feature of this invention to provide specialized types of self-supporting interlocking blocks which will facilitate the assembly of a firm and compact structure without requiring mortar or reinforcing elements.

These and further features of this invention will become apparent from the following description of the drawings.

DESCRIPTION OF THE DRAWINGS

FIG. 1 is a perspective view of a base course of blocks of this invention.

FIG. 2 is a front view of several base course blocks in position showing the succeeding course block about to be placed in position.

FIG. 3 is a perspective view of a partially completed wall using the interlocked blocks of this invention.

DESCRIPTION OF THE INVENTION

Figure 4:
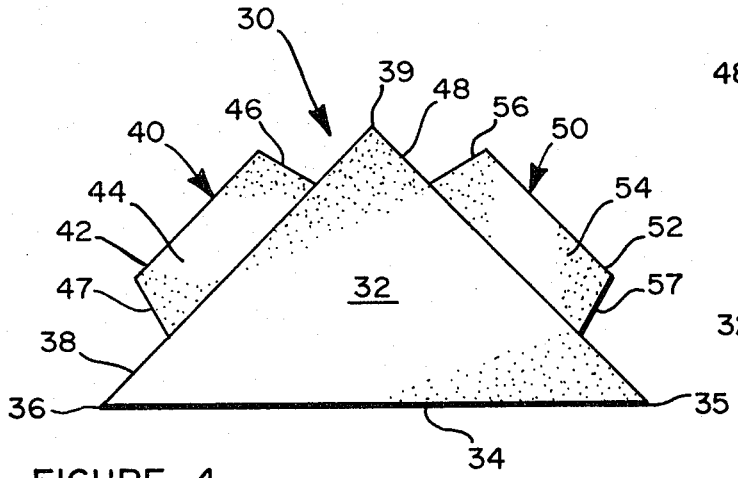
FIG. 4 is a front view of a base course block.

Referring particularly to FIGS. 1, 2 and 3, the general use and application of the block members is shown. In FIG. 1 the base course, generally indicated at 10, is supported on a flat supporting bed of concrete 12, the latter supplying the flat even-starting surface on which the interlocking base course of blocks can be set. The base course consists of a plurality of base blocks 14 placed on the support surface 12 which have upper interlocking elements 16 and 18. The wall generally indicated at 20 in FIG. 3 is built upon this base course. It consists of a plurality of common center blocks 22. The second course consists of common blocks which are set vertically downward on the base course blocks 14 as indicated in FIG. 2 to engage the upwardly extending interlocking elements 16 and 18 of adjacent course blocks. Succeeding courses of common central blocks 22 are then placed in position.

Specially configured corner blocks 24 are shown in FIGS. 1 and 3 to provide a solid interlock between adjacent front and side walls. Finishing blocks 26, and vertical framing blocks 28 permit finished openings to be readily made in the block wall where desired.

Figure 5:
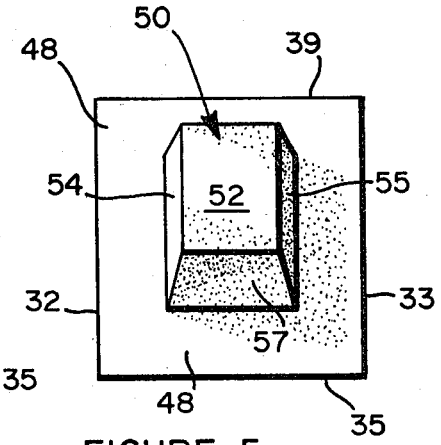
FIG. 5 is a side view of the base course block of FIG. 4.

FIGS. 4 and 5 disclose the base block generally indicated at 30, which has a flat triangular-shaped front face 32 and a matching flat rear surface 33 extending parallel to and in alignment with face 32. The bottom of the block has a flat base surface 34 terminating at apex lines 35 and 36. The inclined upper side face 38 supports a block interlocking element generally indicated at 40, which has a top upper face 42 extending parallel to the upper side face and joined by inclined side pilot face 44 and inclined stop face 46 and lower inclined face 47. An upper peak 39 is formed when the inclined upper side face 38 peaks in the corresponding inclined second upper side face 48. The block interlocking element generally indicated at 50, is of the same shape and configuration as interlocking element 40. Its top face 52 is joined by two angularly oriented side pilot or guide faces 54 and 55 which are inclined toward each other and upwardly from the second upper side face 48. Stop face 56 and lower face 57 are inclined as shown and extend upwardly to intersect with the interlocking element top face 52. The rear face 33, not shown, corresponds in shape and surface to front face 32. For all of the blocks, the front and rear faces are of similar shape and finish. The block interlocking elements extend upwardly from their support surfaces a substantial amount to permit guiding action along the side inclined pilot surfaces 54,55. The base cross block has a length along the base surface 34 of sixteen inches, and the block is eight inches wide. The interlocking block element extends upwardly from its supporting surface one and fifteen-sixteenths inches. At its base, it is five and seven-eighth inches long and four and seven-eighth inches wide. The side pilot or guide faces 54 and 55 are inclined upwardly and toward each other. The width of the interlocking block elements 40 and 50 at their base is four and seven-eighth inches and the length is five and seven-eighth inches. The side guide and pilot faces slope toward each other at approximately a 1 to 2 slope (31/32" to 1 and 15/16"). The upper face of the interlocking element, 46 and 56 at their base are 2 9/32" from the peak 39. These faces have a slight taper being offset 15/32" at the top faces 42,52 from the base. For precision setting and interlocking of the pieces, it is essential that the dimensions be held to within 1/32 of an inch.

Figure 6:
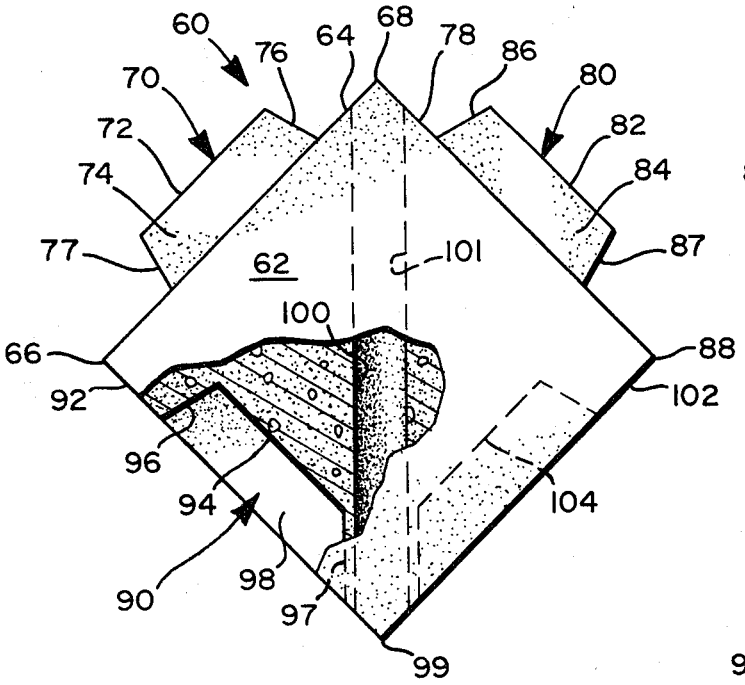
FIG. 6 is a front view partially cut away showing the central common block.
Figure 7:
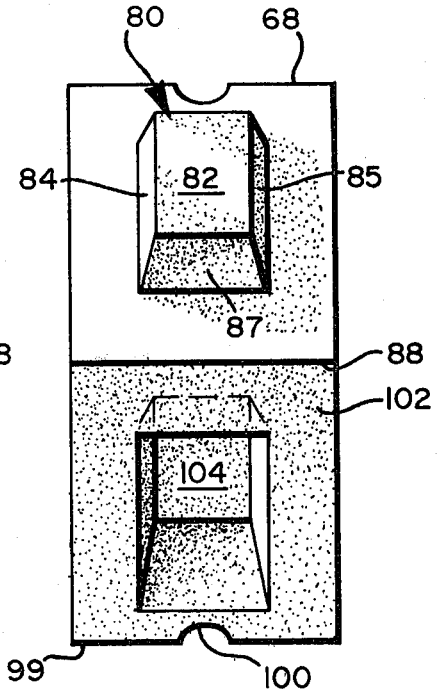
FIG. 7 is a side view of the central common block of FIG. 6.

FIGS. 6 and 7 disclose the central or common block 60 which is used for the major part of the block wall surface.

It has a front face 62, an inclined upper side surface 64 having a lower periphery 66 extending rearwardly of the front face 62 and an apex 68. An interlocking element, generally indicated at 70, has the same configuration and dimensions as interlocking elements 40 and 50 of base block 30. It has a top flat surface 72 and angularly and upwardly extending pilot side faces 74 being shown in FIG. 6. Together with the angularly inclined stop face 76 and bottom face 77, the pilot and stop faces define the upwardly projecting interlocking element 70. The second upper side face 78 is of the same dimension and inclination as upper side face 64 and carries the upwardly extending solid interlocking element 80 which is of the same dimension and shape as interlocking element 70. It should be noted that all of the interlocking elements are large in volume and area as compared to the face from which they project. The interlocking element 80 has the flat top upper face which extends parallel with the second upper side face 78 and has the inclined side pilot faces 84 and 85 which extend between the two parallel faces. The stop face 86 is disposed at the top of the interlocking element 80 and the bottom face 87 and appears as a substantial segment of a pyramidal shape. It should be noted that the upwardly projecting interlocking elements are substantially large in comparison to the dimension of the block, and are approximately one-quarter the height of the base block. This size permits the angled and converging surfaces 84 and 85 to provide a substantial piloting path along their height until the block faces of adjoining blocks are seated and are in contact with one another. Note that the width of the upwardly projecting interlocking elements are each approximately one-third the width of the block face from which they project, and that they extend a length equal to about half the length of the surface from which they project. The line of intersection of the side faces of the projection with the upper side face of the blocks is parallel to the front and rear faces of the blocks.

The size of the inclined faces 38, 48, 64, and 78 are all identical. The preferred dimension being 8" by 11 and 5/16".

The lower faces of the block of FIGS. 6 and 7 carry or have two inwardly projecting receiving cavities, as indicated at 90 in FIG. 4, for receiving the upwardly projecting block interlocking elements of the course of blocks immediately below it, as can be seen with reference to FIG. 2 and blocks 14 and 22.

The block interlocking element receiving cavity 90 is of the size and shape to accurately engage the upwardly projecting surfaces of the corresponding interlocking block element. The receiving cavity has a flat end surface which runs parallel to the surface 92. An inclined top engaging surface 96 is parallel to the angular inclination of the corresponding stop surface 86 on projection 80 while surface 94 is parallel to corresponding surface 82. The lower extending flat surface 97 of the receiving cavity 90 is disposed so as to be in a vertical plane when the block 62 is lowered into position on the adjacent lower course blocks. It is parallel to the line between the peak 68 and the apex 99 of the block. The side surface 98 of the receiving cavity acts as the side upwardly extending surface 85 of the upwardly extending block interlocking element 80 on a lower diagonally displaced block. A vertical central bore 100 extends between the peak 68 and the lower apex 99 of the block and essentially is used as a weight-reducing cavity that will also permit the use of conduit lines if desired. The other flat lower inclined block face 102 is of the same inclination, and size as that of face 92 and has a receiving cavity 104 which is of the same size and shape as receiving cavity 90 previously described.

Figure 8:
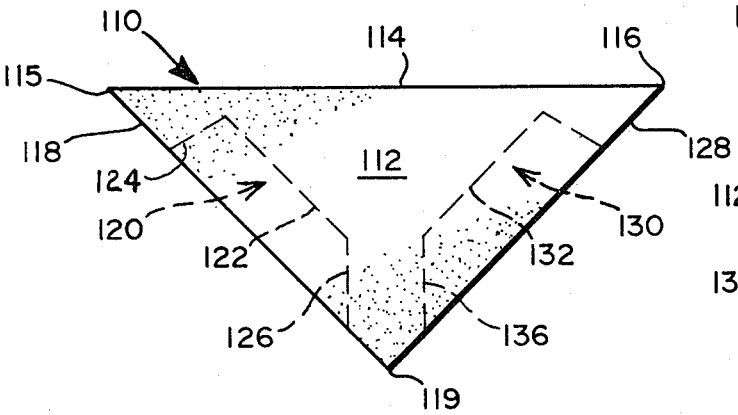
FIG. 8 is a front view of a top course block.
Figure 9:
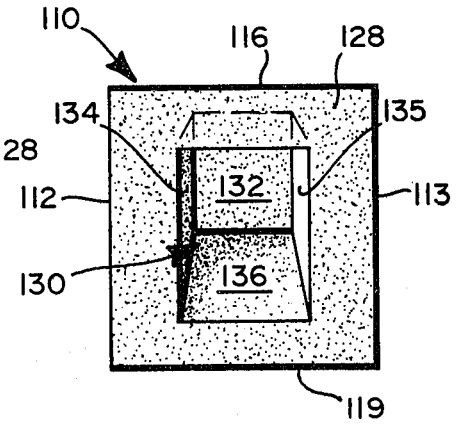
FIG. 9 is a side view of the top course block of FIG. 8.

A top finishing block 110 is shown in FIGS. 8 and 9. It is used for the top course as well as for other top surfaces, such as the lower surface of a window opening in the wall. The block 110 has a triangular face 112 the same size as face 32 of block 30. It has a top planar rectangular surface 114 having side edges 115 and 116 extending behind and meeting the apexes of the front face 112. A downwardly inclined rectangular side face 118 terminates at the lower apex 119. It has an interlocking projection receiving cavity 120 of similar size and construction as the receiving cavity 90 of block 60. The rear surface 122 is rectangular and is parallel to the block side face 118. The inclined engaging face 124 is of the same size and shape as the stop face on the interlocking element with which it engages, while the side faces are inclined and sized to permit engaging with the pilot surfaces of the block interlocking element extending upwardly from lower block surfaces. The end face 126 is angled so as to provide no obstruction or interference with the projecting interlocking block element as the block is lowered into its fixed final position on the wall.

The other downwardly extending planar and rectangular side face 128 extends from line 116 to the apex line 119. It is the same size as face 118, and all the other inclined surfaces of the other blocks. The interlocking receiving cavity 130 occupies a substantial portion of the side face 128 and is proportioned and dimensioned to receive the block interlocking element of the block to be disposed immediately below the finishing block. The cavity 130 has the same shape and size as the cavity 104 of the common central block 60. The rear planar wall 132 within the cavity is parallel to the lower side face 128 and the bottom wall 136 extends downwardly so as not to interfere with the upwardly projecting block interlocking element during the course of its being seated within the cavity. The inwardly inclined side walls 134 and 135 are inclined at the same angular configuration as the inclined side walls of the upwardly projecting block interlocking element 70 of FIG. 6.

Figure 10:
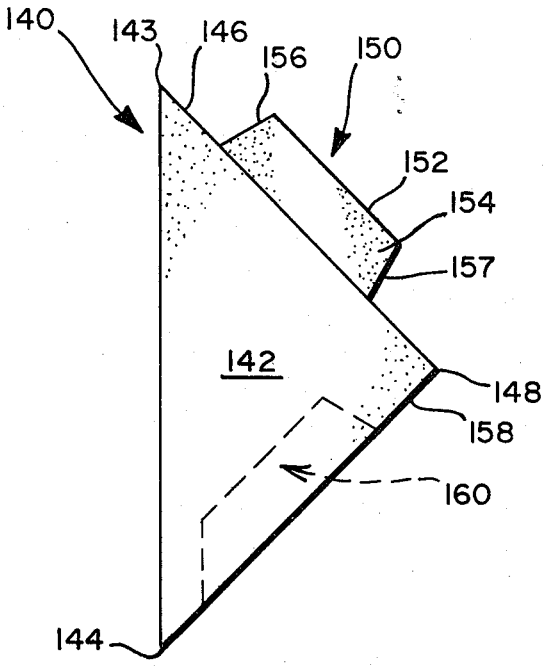
FIG. 10 is a front view of a framing block.
Figure 11:
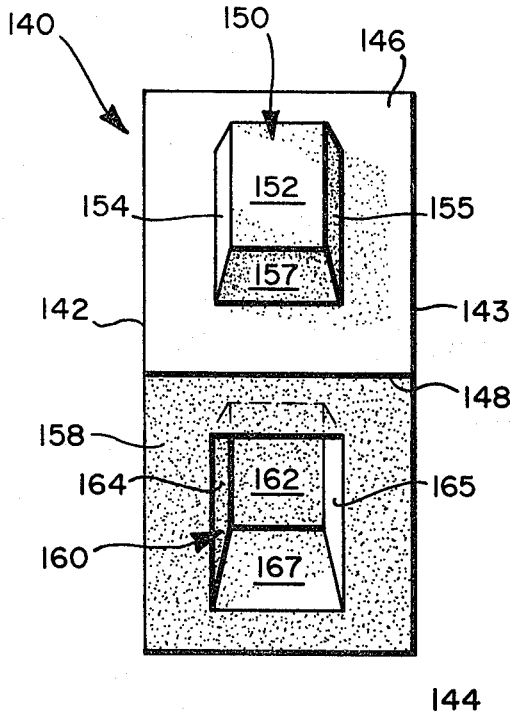
FIG. 11 is a side view of the framing block of FIG. 10.

A framing block generally indicated at 140 is shown in FIGS. 10 and 11. It has a triangular front face 142. A side face 145 extends between lines 143 and 144. The side upper inclined face 146 extends downwardly from the peak 143 to the apex line 148 and has an upwardly extending interlocking element 150 which occupies a major portion of its surface. The block interlocking element has a top flat rectangular face 152 substantially parallel to the side face 146 and inwardly inclined pilot and guide faces 154 and 155 extending between the inclined side face and the top face 152 of the interlocking element. The top stop surface 156 and the bottom flat surface 157 complete the surfaces of the interlocking element. This interlocking element 150 is identical to the block interlocking elements 50 and 80 of the previously discussed block 30 and 60.

The lower inclined face 158 is rectangular in shape and extends between the triangular apex lines 144 and 148. A block interlocking element-receiving cavity 162 occupies the main portion of its surface. It has a back surface 162 parallel to the surface 158 and angularly inclined walls 164 and 165. The bottom wall 167 extends downwardly so as to clear the surfaces of the interlocking element when block 140 is set in position. The shape of the receiving cavity is the same as receiving cavities 104 and 130 of common block 60 and finishing block 110, respectively.

Figure 12:
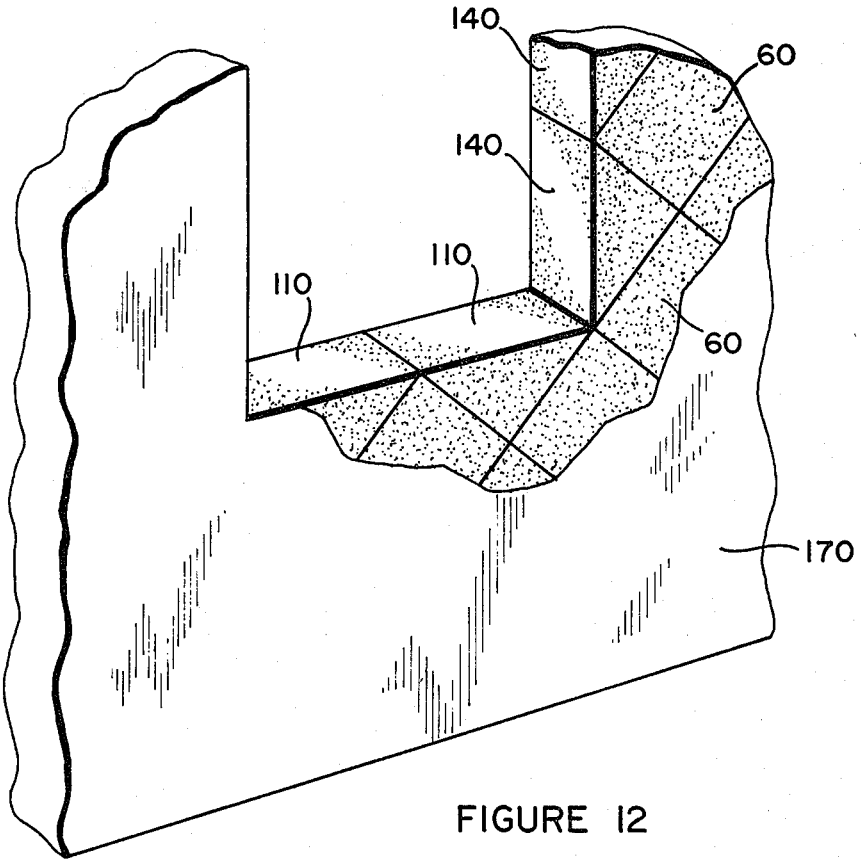
FIG. 12 is a perspective view of a portion of a finished wall showing part of the wall without facing to show the interfitted blocks.

FIG. 12 shows a portion of a wall 170 having a part of the overcoat removed to disclose the interlocked common blocks 60 forming the main part of the wall, and the window area. The figure shows the blocks used for window construction which utilizes the top finishing blocks 110 for the lower sill surface of the opening, and the side framing blocks 140 for the vertical periphery of the opening. Base blocks 30 are used to above lintel (not shown), to complete the framing of the opening. The blocks 140 can be used along all window and doorway openings for providing vertical side surfaces.

Figure 13:
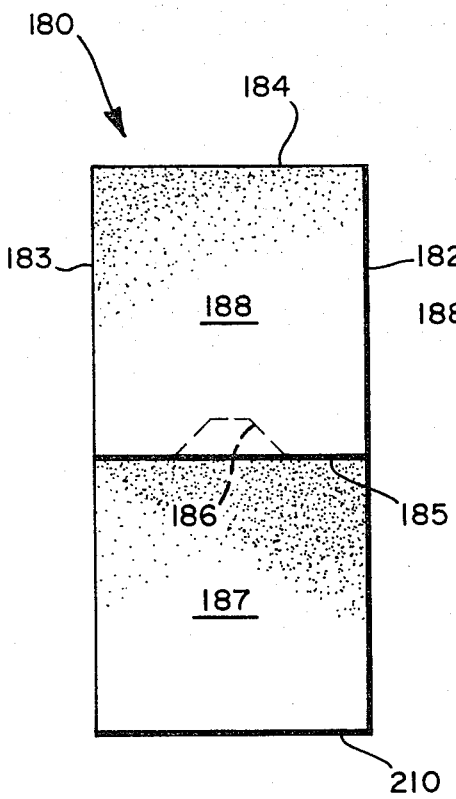
FIG. 13 is an end view of an upper base corner block.
Figure 14:
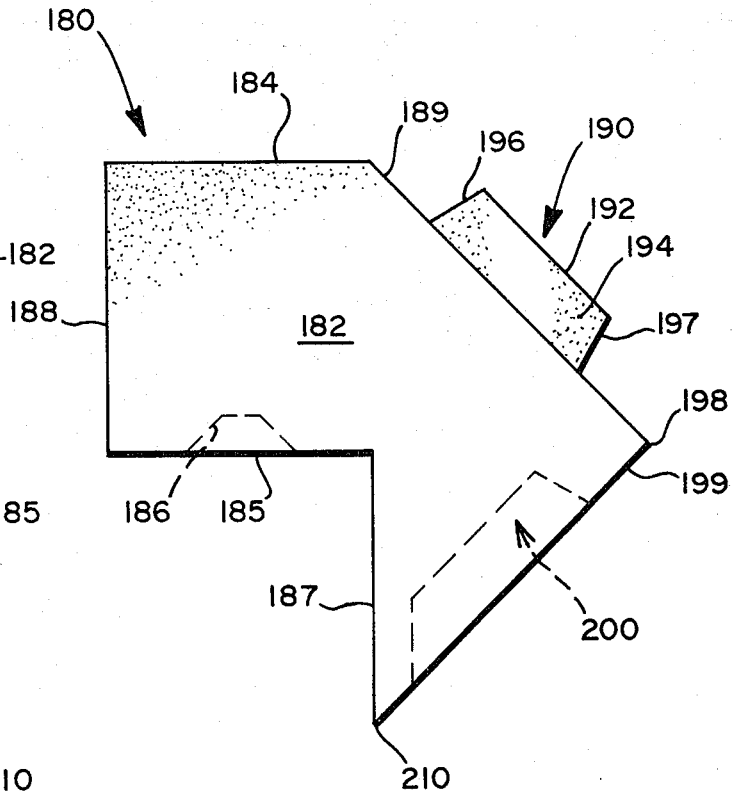
FIG. 14 is a front view of the upper base corner block of FIG. 13.

FIGS. 13 to 16 disclose the two types of corner blocks which are used to join adjacent walls together and to form the intersecting corner for them. FIGS. 13 and 14 disclose an upper rectangular section corner block 180 having a front face 182 and an upper rectangular horizontal face 184 defining a rectangular block section which has a rectangular lower face 185 containing a block interlocking element-receiving cavity 186. The rectangular portion of the corner block has a rectangular vertical side face 188. An upper downwardly inclined face 189 has an upwardly extending block interlocking element 190 of similar construction and dimension to the interlocking elements previously discussed. It has a flat face 192, inclined faces 194 and 195, a stop face 196, and a lower face 197. The lower edge 198 of the downwardly inclined face 189 provides a peak which intersects the surface and forms the edge of downwardly inclined surface 199. This is disposed at 90° or perpendicularly to the surface 189. It has an interlocking block assembly 200 and terminates along the line of intersection 210 with the vertical rectangular face 187. Preferably, the faces 187 and 188 are square in outline and are of the same dimension. Essentially, block 180 is a combined structure having the finishing block 140 as a portion thereof and a rectangular block integral with the upper vertical half of the side face leaving the other half 187 of the side face exposed for engagement with adjacent blocks.

Figure 15:
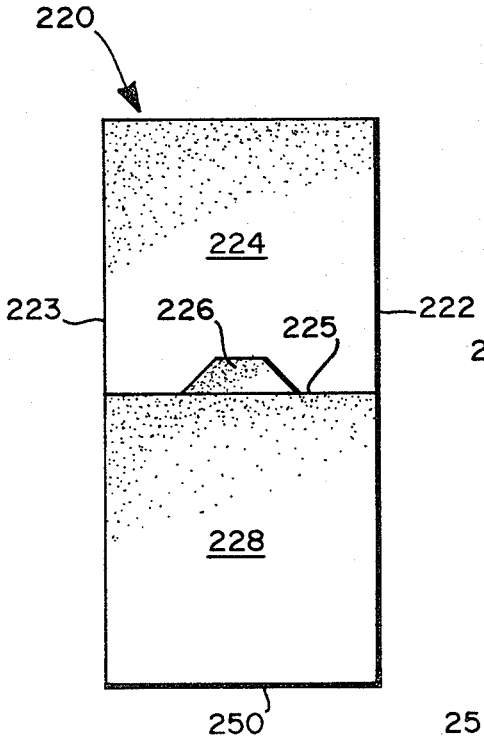
FIG. 15 is a side view of a lower base corner block.
Figure 16:
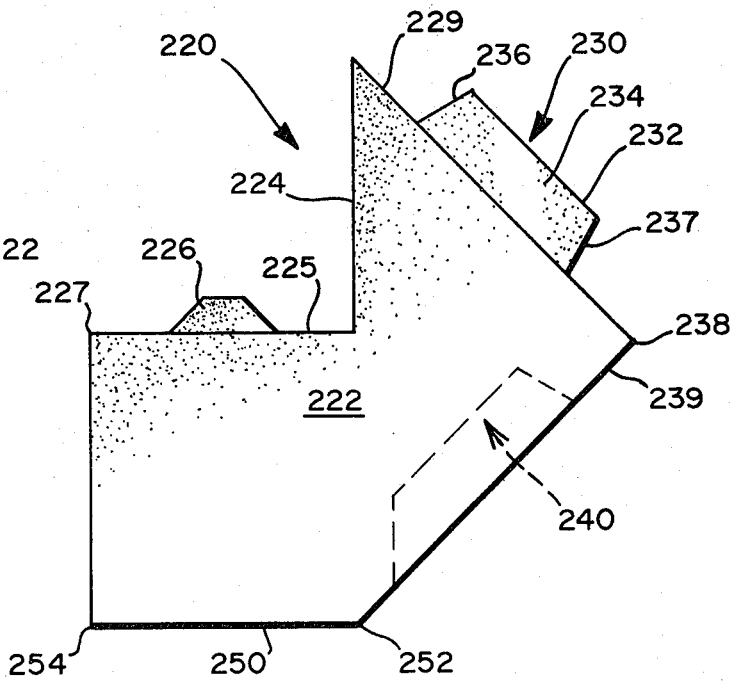
FIG. 16 is a front view of the upper base block of FIG. 15.

FIGS. 15 and 16 show a corresponding corner block 220 which is interfitted with the block 180 to form a corner for two adjacent wall structures. The block 220 has a front face 222 and a rear face 223 which are parallel to each other and separated by a square-shaped upper vertical surface 224. The horizontal square surface 225 is disposed perpendicularly to the vertical surface 224. Surface 225 has an upward interlocking tab 226 and extends to the line of intersection 227 with the surface 228. This forms a rectangular block section adjacent to which is a triangular block section identical in construction with the block 140 previously discussed. Downwardly inclined surface 229 has the upwardly extending interlocking element 230 which has a flat upper face 232, the inclined side wall 234, the pilot surface 236 and the lower surface 237. The downwardly extending surface 229 meets the downwardly inclined surface 239 at a ninety-degree angle forming a line of intersection 238. The surface 239 has an interlocking element-receiving cavity 240, and is bounded at its lower edge by the line 252 which joins the lowermost horizontal bottom surface 250 and extends between the lines of intersection 252 and 254. It is the same dimension and is parallel to the upper block surface 225.

The block interlocking receiving cavity 240 is of the same shape and size as the block interlocking cavity 200 of block 180 as well as the receiving cavities 104 and 160. The manner of interlocking the blocks is shown in FIG. 1 and FIG. 3. As shown in FIG. 1, the lowermost block is block 220. Block 180 is interfitted on top of it at right angles with the interlocking tab 226 being received within the cavity 186 such that face 185 rests on face 225, and the front face of block 180 has its rectangular section in direct contact with side face 224 of block 220.

All of these blocks when interengaged with each other provide a firm stable interconnection such that mortar is not required to hold the blocks in position. The block interlocking elements when seated in the receiving cavities provide an accurate fit in the wall. All blocks are held to very close tolerances, and the wide angular sloped surfaces from which the block interlocking elements project, as well as the elements themselves, provide a close-fitting, tight frictional fit which is stable and effectively resists lateral shifting.

The inclined pilot and guide surfaces of the block interlocking elements permits an unskilled laborer to merely set the block down on the preceding course in rapid fashion and the block interlocking element guiding surfaces between the element and the cavity will ensure a correct accurate fit of the block.

The orientation of the blocks in a diamond configuration together with the block interlocking configuration provide the stability and strength of lateral resistance required for a mortarless wall construction.

It should also be noted that the interlocking configuration is centrally located and occupies a substantial percentage of interfitting faces. This is also a factor in the stability obtained by this construction.

When started on a level base, such as the concrete slab 12 of FIG. 1, the blocks provide a self-leveling feature in that they vertically project downwardly and have an accurate fit determined by the wedging interaction of the lower inclined faces of the block and the stop faces of the block interlocking elements of the preceding course of blocks. The accurate dimensions and fit of the blocks themselves, without the inaccuracy introduced by a layer of mortar, keep all of the blocks in a level course which would be impossible with constructions employing a mortar filler.

Inasmuch as the constructions of each of the inclined side faces are identical, the blocks can be reversed 180° such that either of the two parallel spaced and identical front and rear faces may be used on the outside of the wall.

The wedge action due to the manner in which the blocks are set, coupled with the substantial size and close tolerances of the block interlocking elements and their receiving cavities provide a tight fitting wall construction which is not possible with any of the prior type of interlock block constructions.

The several special constructions of base, finishing, and framing blocks, together with interlocked block construction elements provide a versatility of construction in which wall sides and door and opening size and position can be varied as desired.

These blocks may also be used on a smaller scale as a toy.

While this invention has been described, it will be understood that it is capable of further modification, uses and/or adaptations of the invention following in general the principle of the invention and including such departures from the present disclosure as come within known or customary practice in the art to which the invention pertains, and as may be applied to the essential features hereinbefore set forth, as fall eithin the scope of the invention or the limits of the appended claims.

What I claim is:

1. An interlocking block construction, comprising:

(a) a solid wide building block having a flat front face and a parallel flat matching aligned rear face extending parallel to and spaced from the front face, (b) two identical rectangularly-shaped upwardly-extending upper flat faces extending rearwardly and perpendicular from the front face along each top edge, (c) the upper flat faces being angularly inclined toward each other and meeting along the line of intersection which forms an upper central peak extending rearwardly and perpendicular to the front face, (d) each upper flat side face having a matching solid laterally thick block interlocking element approximately one-third the width of the block extending upwardly therefrom which is centrally located on the upper side face and accurately spaced from the front and rear faces as well as the upper peak of the block to provide solid lateral strength, (e) each block interlocking element including two flat upwardly-facing inwardly inclined side pilot surfaces of the same width and length which extend parallel to the front face and are angularly inclined toward each other so as to provide centering and guide action, (f) the block interlocking element having a flat top support face extending between the inclined pilot surfaces and parallel to the upper flat side face, (g) the block interlocking element also including an upwardly facing stop face connecting the two separately engaging pilot surfaces and inclined at a slightly greater angle than 90° to the upper peak whereby a complementary surface of an adjacent block can be accurately guided into position and supported on the upper flat face, (h) the vertically disposed front face has two equally downwardly inclined lower edges which meet at a central lower apex in direct vertical alignment with the upper apex, (i) a flat lower side face extending rearwardly and perpendicular from the front face at each lower edge and angularly inclined toward each other meeting along a lower line of intersection extending rearwardly and perpendicular to the front face, (j) each flat lower side face having a centrally disposed receiving cavity which complements the block interlocking element on the opposite side of the upper peak and identically spaced from the plain of the adjacent upper side face, and, (k) the lower extending flat surface of each cavity being sufficiently spaced and inclined to permit vertical implacement of the block without contacting the lower most surface of the interlocking element on a lower course when the blocks are vertically assembled.

2. The interlocking block construction is set forth in claim 1, wherein:

(a) the lower extending flat surface of the cavity is parallel to a line extending from the peak of the block to its lower apex.

3. The interlocking block construction as set forth in claim 1, wherein:

(a) the interlocking elements extend approximately ½ the length of the upper flat side face from which it projects.

4. The interlocking block construction as set forth in claim 1, wherein:

(a) the inwardly inclined side pilot surfaces sloped toward each other at approximately a 1 to 2 slope, and (b) interlocking elements project upwardly from the flat side face approximately ¼ the height of the base block measured along its side face.

5. The interlocking block construction as set forth in claim 1, wherein:

(a) the inclined pilot faces of the block interlocking element are inclined at a slope from twenty to forty-five degrees.

6. The interlocking block construction as set forth in claim 1, wherein:

(a) the dimensional reference of all of the surfaces is held to a close tolerance on the order of one-sixteenth of an inch.

* * * * *